US005432984A

United States Patent [19]

Petzl

[11] Patent Number: 5,432,984

[45] Date of Patent: Jul. 18, 1995

[54] ADJUSTABLE SELF-CLAMPING ATTACHMENT LOOP OF A STRAP

[75] Inventor: Pierre Petzl, St Nazaire les Eymes, France

[73] Assignee: Zedel, Crolles, France

[21] Appl. No.: 204,099

[22] Filed: Mar. 2, 1994

[30] Foreign Application Priority Data

Mar. 11, 1993 [FR] France ..... 93 02929

[51] Int. Cl.[6] ..... A44B 11/00

[52] U.S. Cl. ..... 24/197; 24/170; 24/196

[58] Field of Search ..... 24/197, 170, 193, 200, 24/519, 68 R, 68 CD

[56] References Cited

U.S. PATENT DOCUMENTS

| | | | |
|---|---|---|---|
| 1,697,833 | 1/1929 | Lane | 24/170 |
| 1,997,653 | 4/1935 | Reiter . | |
| 2,079,457 | 5/1937 | Laurisin | 24/170 |
| 2,563,809 | 8/1951 | Ash | 24/197 |
| 2,807,852 | 10/1957 | Rave | 24/197 |
| 3,277,543 | 10/1966 | Gaylord . | |
| 3,407,452 | 10/1968 | Abert et al. | 24/197 |
| 3,876,249 | 4/1975 | Nilsson | 24/197 |
| 4,175,304 | 11/1979 | Bentley . | |
| 4,299,014 | 11/1981 | Wood | 24/197 |
| 4,670,945 | 6/1987 | Banks . | |

FOREIGN PATENT DOCUMENTS 567345 2/1924 France .

*Primary Examiner*—Victor N. Sakran

*Attorney, Agent, or Firm*—Stevens, Davis, Miller & Mosher

[57] ABSTRACT

A self-clamping attachment loop of a strap comprises a pair of superposed rings in the form of rectangular frames having two openings of different sizes, and a transverse slot for the strap to pass through. The loop is either in a locked position following application of a clamping force or in an unlocked position due to a voluntary unlocking action causing sliding of the second ring and an increase of the passage zone of the strap in the slot after rocking of the loop. The external edge of the cross-piece of the second ring is located permanently away from the parallel edge of the first ring in order not to hamper the rocking movement.

6 Claims, 2 Drawing Sheets

ADJUSTABLE SELF-CLAMPING ATTACHMENT LOOP OF A STRAP

BACKGROUND OF THE INVENTION

The invention relates to an adjustable self-clamping loop of a strap composed of a pair of rings superposed according to two parallel planes, and presenting rectangular frames of different sizes, the larger first ring comprising a rectangular first opening located under a rectangular second opening arranged in the smaller second ring, in such a way as to define a transverse slot for passage of the strap, the slot being arranged between one of the external edges of the second ring and the corresponding large side of the first opening of the first ring, the loop being either in a locked position of the strap in the slot following application of a clamping force or in an unlocked position due to a voluntary unlocking action causing sliding of the second ring and an increase of the passage zone in the slot after a rocking movement of the loop.

In this first type of state-of-the-art attachment loops of the kind referred to, the rocking movement by voluntary unlocking action was appreciably hampered by the relative movement of the second ring. Unlocking of the loop then requires a great force to overcome the self-clamping effect of the strap.

A second type of self-clamping loop comprises a single rectangular ring, and a cross-piece movable in translation in the central opening. The opposite ends of the cross-piece cooperate with guiding means provided on two parallel opposite sides of the ring. The structure and manufacture of such an attachment loop are complicated.

SUMMARY OF THE INVENTION

The object of the invention consists in improving unlocking of an attachment loop of the first type, and in simplifying manufacture thereof.

The loop according to the invention is characterized in that the width e2 of the first cross-piece of the second ring opposite the slot is smaller than the width e1 of the bottom branch of the first ring, and that the first edge of said branch is arranged as a pivoting axis when the rocking movement of the loop to the unlocked position takes place, the second external edge extending along said cross-piece of the second ring, and being located appreciably away from the first parallel edge during said movement.

This results in the rocking movement taking place only around the external edge of the first ring until the strap is unlocked. The unlocking force required to achieve rocking of the strap to the unlocked position is relatively low.

BRIEF DESCRIPTION OF THE DRAWINGS

Other advantages and features will become more clearly apparent from the following description of an illustrative embodiment of the invention, given as a non-restrictive example only and represented in the accompanying drawings in which.

DETAILED DESCRIPTION OF THE PREFERRED EMBODIMENT

Figure 2:
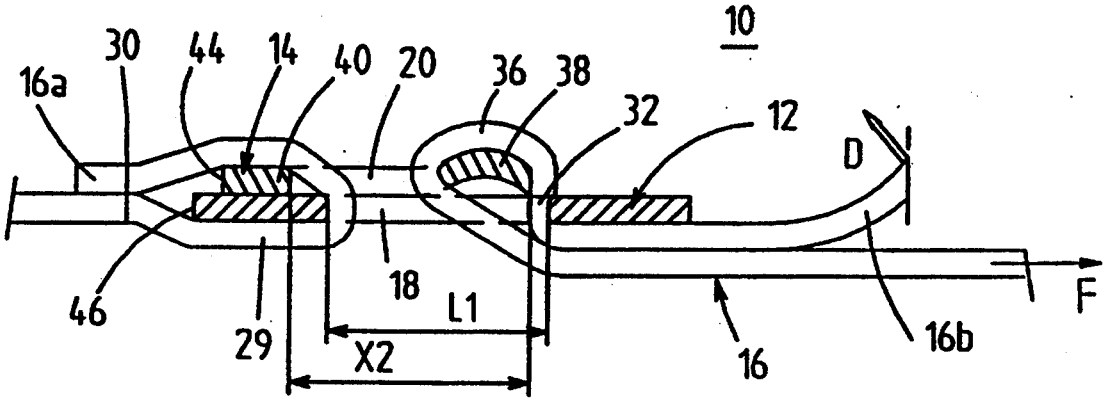
FIG. 2 shows a cross-sectional view along the line 2—2 of FIG. 1.
Figure 1:
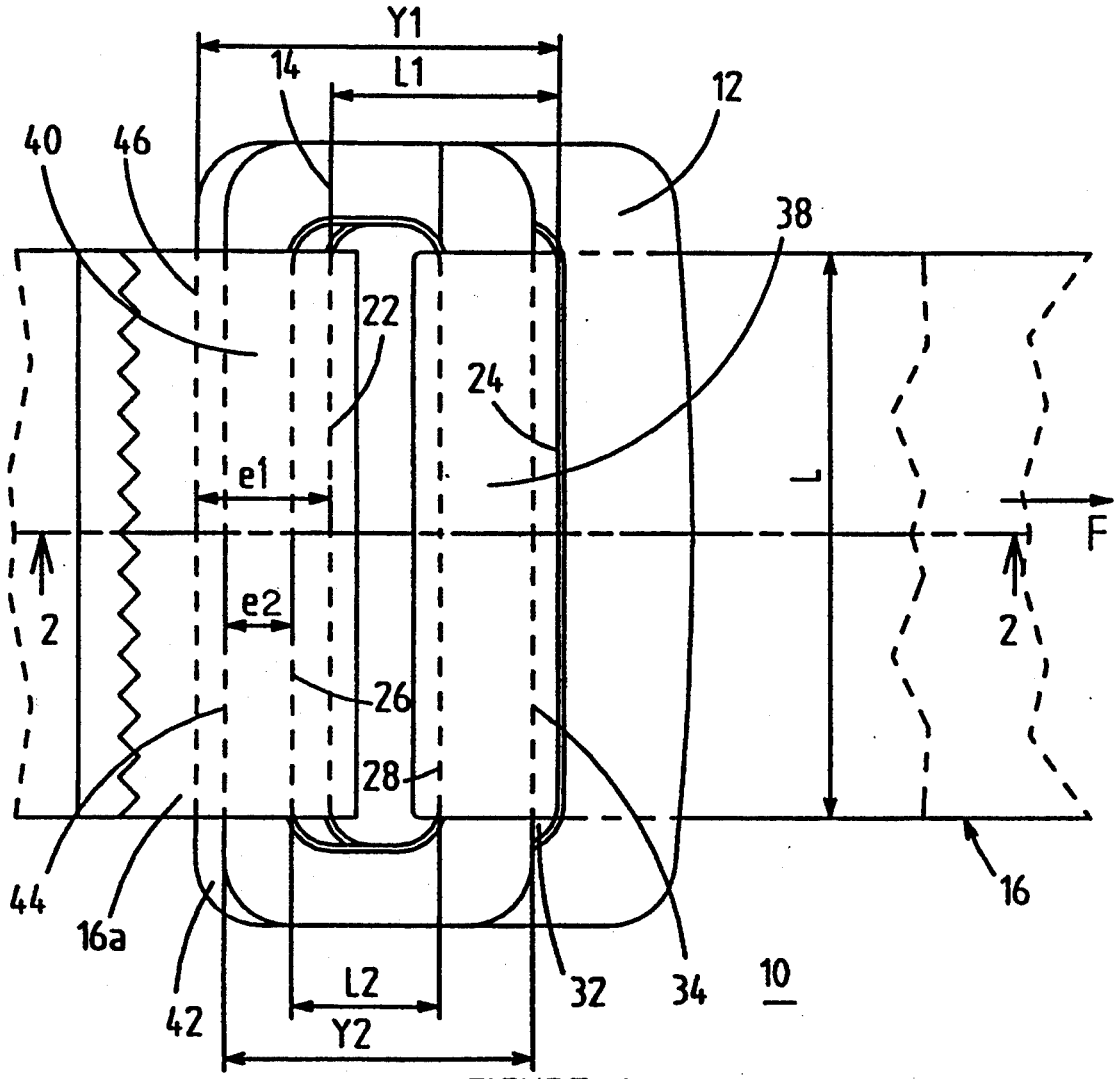
FIG. 1 is an elevational view of the attachment loop according to the invention, represented in the locked position of the strap.
Figure 3:
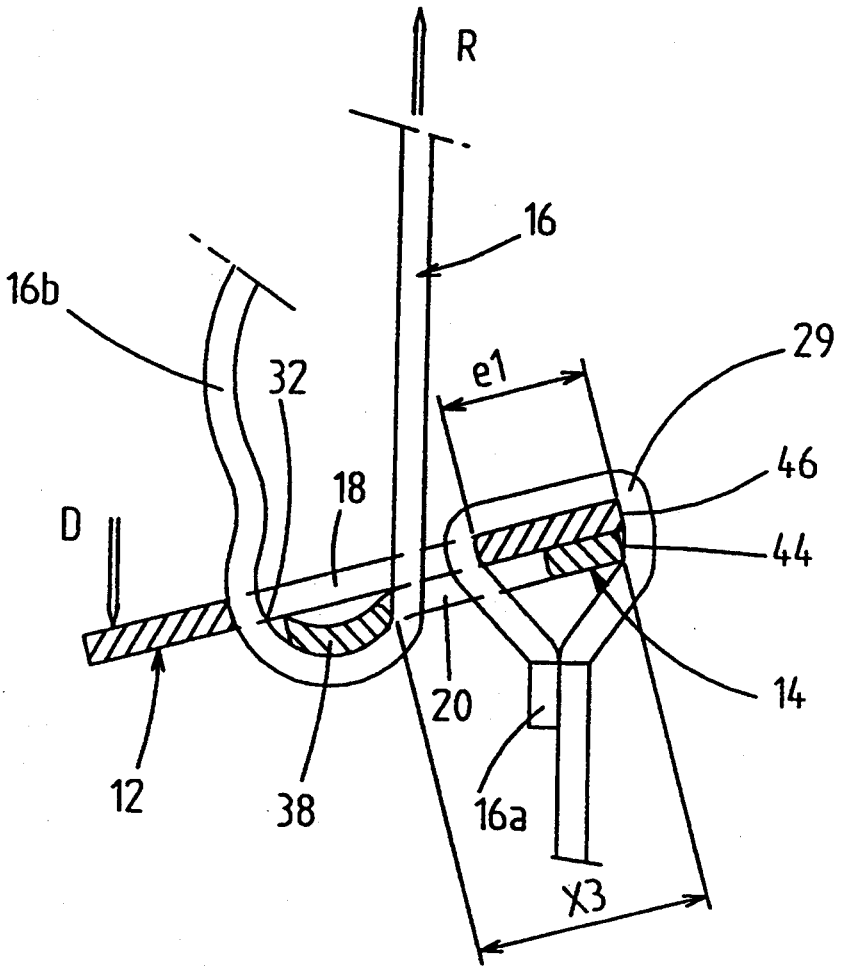
FIG. 3 is an identical view to FIG. 2 in the unlocked position of the loop.

In FIGS. 1 to 3, an adjustable self-clamping attachment loop 10 is composed of a pair of rings 12, 14 superposed according to two parallel planes, with passage of a strap 16 equipping a belt or a harness.

The two rings 12, 14 present rectangular structures of different sizes. The larger first ring 12 comprises a first rectangular opening 18 located under an adjacent second opening 20 arranged in the second ring 14 of smaller size.

The large sides 22, 24; 26, 28 parallel two by two of each rectangular opening 18, 20 are equal and extend according to the transverse direction of the strap 16. The distance L1 measured according to the longitudinal direction of the strap 16 between the large sides 22, 24 of the first opening 18 is greater than the distance L2 arranged between the large sides 26, 28 of the second opening 20.

The width I of the strap 16 is slightly less than the large sides 22, 24; 26, 28 to prevent any friction of the lateral edges of the strap 16 against the small sides of the openings 18, 20.

One of the ends of the strap 16, designated by the reference **16*a* in FIGS. 1 and 2, passes in the left-hand part of the loop 10 (see FIGS. 1 and 2) under the bottom face of the first ring 12, then passes through the two openings 18, 20, and is folded back above the top face of the second ring 14 forming a turn 29 closed by a seam 30, or by any other assembly means. The loop 10 is thus fitted securedly due to the presence of the turn 29**.

The other end **16*b* of the strap 16 also passes through the two openings 18, 20 on the right-hand part of the loop 10, after passing under the bottom face of the first ring 12. The end 16*b* is then inserted in a transverse slot 32 situated between the external edge 34 of the second ring 14 and the large side 24 of the first opening 18, and finally comes into engagement against the bottom face of the first ring 12 forming a turn 36 around the right-hand cross-piece 38 of the second ring 14**.

A traction force exerted on the strap 16 in the direction of the arrow F (indicated in FIGS. 1 and 2) causes longitudinal movement of the two rings 12, 14 towards one another and jamming of the strap in the slot 32. This results in a self-clamping effect of the strap 16, which remains effective unless a voluntary unlocking action is made on the loop 10.

The other left-hand cross-piece 40 of the second ring 14 has a width e2 which is smaller than the width e1 of the left-hand transverse branch 42 of the first ring 12.

Release of the strap 16 is achieved by a voluntary action raising the first ring 12 in the direction of the arrow D (FIG. 2) so as to move the loop 10 to the loosened position of FIG. 3. The loop 10 is thus animated with a rocking movement comprised between 90° and 180°.

During rocking of the loop 10, the external second edge 44 extending along the cross-piece 40 of the second ring 14 remains appreciably away from the parallel first edge 46 of the branch 42 of the first ring 12. The edge 46 acts as pivoting axis for the loop 10, and the second ring 14 slides on the first ring 12 in the course of rocking, so as to increase the width of the slot 32, resulting in suppression of the self-clamping effect of the strap 16 (FIG. 3).

The relative sliding movement of the two rings 12, 14 between the locked position (FIG. 2) and the unlocked position (FIG. 3) generates a progressive movement of the edge 44 of the cross-piece 40 towards the straight edge 46 of the branch 42. The unlocking travel of the second ring 14 is a millimeter or a few millimeters, and it is then possible either to adjust the length of the strap 16 or to extract the strap 16 from the loop 10.

It can be noted that to obtain reliable and practical operating conditions of the loop 10, a compromise has to be made between the jamming effect of the strap in the locking phase and the unclamping effect of the strap when unlocking the loop. To this end, the distance X2 between the large side 26 and the external edge 34 of the second ring 14 must be greater than the size L1 of the first opening 18 of the first ring 12 to ensure jamming of the strap in the slot 32 of the loop 10 in the presence of a tension exerted in the direction of the arrow F.

To facilitate unlocking, in addition to the condition that the width e1 of the branch 42 be greater than the width e2 of the cross-piece 40, the external width Y2 of the second ring 14 must also be smaller than the distance Y1 between the external edge 46 and the internal large side 24 of the first ring 12. Dimensioning in this manner enables the second ring 14 to move back when the relative sliding movement to widen the slot 32 takes place following unlocking by rocking.

In the unlocked position of FIG. 3, a free passage always remains for the strap 16 between the large side 28 of the second opening 20 and the large side 22 of the first opening 18. This passage is maintained due to the difference in size between the length X3 between the large side 28 and the external edge 44 of the second ring 14 and the width e1 of the branch 42 of the first ring 12. The length X3 must be greater than the width e1 plus twice the thickness of the strap in order to avoid jamming of the strap in the afore-mentioned free passage.

To relock the loop 10 from the position of FIG. 3, the strap 16 simply has to be pulled in the direction of the arrow R to return the loop 10 to the locked position of FIG. 2.

The loop 10 is made of metallic material, notably by cutting a steel plate, and the cross-piece 38 of the second ring 14 advantageously presents a convex curved part strengthening the mechanical rigidity.

According to an alternative embodiment (not represented), the shape of the openings 18, 20 can be square, and the loop can be made of plastic material with high mechanical strength.

The ends 16*a* and 16*b* can belong to two distinct straps.

The extremity of the end 16*b* can comprise a hem to make the strap impossible to remove.

The invention can be applied for harnesses or belts used in pot -holing, mountaineering, mountain climbing, work on construction sites, etc.

I claim:

1. An adjustable self-clamping loop of a strap comprising:

a pair of rings superposed according to two parallel planes, and presenting rectangular frames of different sizes, a single rectangular first opening located in the larger ring, under a single rectangular second opening arranged in the smaller ring, said larger ring defining first and second crosspieces and said smaller ring defining first and second cross-pieces, each cross-piece having an internal and external side, the internal side of the second cross-piece of the larger ring together with the external side of the second cross-piece of the smaller ring defining a slot transverse to said strap, said strap passing through the rectangular openings of each ring around the second cross-piece of the smaller ring and through the slot to form said loop, said loop being in a locked position when said external side of said second cross-piece of said smaller ring forces said strap tightly against the internal side of said second cross-piece of said larger ring, said loop being in an unlocked position when the external side of the second cross-piece of the smaller ring does not force the strap against the internal side of the second cross-piece of the larger ring, the first cross-piece of the smaller ring having a width which is smaller than the width of the first cross-piece of the larger ring, the external edge of the first cross-piece of the larger ring acting as a pivot when the second cross-piece of the larger ring is rocked to unlock the loop by movement away from the strap, the external edge of the first cross-piece of the smaller ring being located appreciably away from said pivot during said rocking, one of the ends of a strap passing around the first cross-pieces of the larger and smaller rings and forming a turn closed by a seam, a distance between the external sides of the first and second cross-pieces of the smaller ring being less than a distance between the external side of the first cross-piece of the larger ring and the internal side of the second cross-piece of the larger ring to enable the withdrawal movement of the smaller ring to widen the slot during unlocking, and a distance between the internal side of the first cross-piece of the smaller ring and the external side of the second cross-piece of the smaller ring being greater than a distance between the internal sides of the first and second cross-piece of the larger ring.

2. The adjustable loop according to claim 1, wherein the second cross-piece of the smaller ring comprises a convex curved part.

3. The adjustable loop according to claim 1, wherein the first and second cross-pieces of each ring are parallel and the distance between the internal side of the first cross-piece of the larger ring and the internal side of the second cross-piece of the larger ring is greater than the distance, between the internal side of the first cross-piece of the smaller ring and the internal side of the cross-piece of the smaller ring, the strap having a width which is smaller than lengths of the cross-pieces of each ring.

4. The adjustable loop according to claim 1, wherein a distance between the external side of the first cross-piece of the smaller ring and the internal side of the second cross-piece of the smaller ring is greater than a distance between the internal and external side of the first cross-piece of the larger ring plus twice a thickness of the strap.

5. The adjustable loop according to claim 1, wherein both rings are made of metallic material.

6. The adjustable loop according to claim 1, wherein both rings are made of plastic material.

* * * * *